US005390794A

United States Patent [19]

Vulpitta

[11] Patent Number: 5,390,794

[45] Date of Patent: Feb. 21, 1995

[54] MULTIPLE INFORMATION UNIT PACKAGING CARD

[75] Inventor: Brian A. Vulpitta, Avon Lake, Ohio

[73] Assignee: Manco, Inc., Westlake, Ohio

[21] Appl. No.: 82,287

[22] Filed: Jun. 24, 1993

[51] Int. Cl.[6] ..... B65D 73/00

[52] U.S. Cl. ..... 206/459.1; 206/45.14; 206/461; 206/806

[58] Field of Search ..... 206/459.5, 461, 476–483, 206/486–490, 493, 495, 806, 45.14, 45.28, 45.11, 45.13, 459.1; 40/312

[56] References Cited

U.S. PATENT DOCUMENTS

| | | | |
|---|---|---|---|
| 2,198,138 | 4/1940 | Sutton | 206/482 |
| 3,462,012 | 8/1969 | Fineman et al. | 206/459.1 |
| 3,770,120 | 11/1973 | Hanson | 206/486 X |
| 4,669,611 | 6/1987 | Flaherty | 206/459.5 X |
| 4,739,878 | 4/1988 | DiDomenico | 206/806 X |
| 4,911,287 | 3/1990 | Speers | 206/459.5 X |
| 5,201,413 | 4/1993 | DeBlasio et al. | 206/459.1 X |

FOREIGN PATENT DOCUMENTS

| | | | |
|---|---|---|---|
| 70396 | 6/1915 | Austria | 206/479 |
| 2239386 | 2/1975 | France | 206/459.1 |
| 313221 | 10/1919 | Germany | 206/486 |
| 376953 | 7/1932 | United Kingdom | 206/45.28 |
| 2085844 | 5/1982 | United Kingdom | 206/482 |

OTHER PUBLICATIONS

Photocopy of Unit of Manco Clear Carton Sealing Tape Identified as Document "A".

Photocopy of Unit of Manco Magnetic Tape Dispenser Identified as Document "B".

*Primary Examiner*—Bryon P. Gehman

*Attorney, Agent, or Firm*—Vickers, Daniels & Young

[57] ABSTRACT

A packaging card for displaying multiple units of a product is convertible into multiple packaging cards for displaying individual units of a product. The multiple unit packaging card contains an appropriate UPC symbol and the individual packaging cards contain individual UPC symbols which are hidden when multiple units of the product are displayed.

2 Claims, 3 Drawing Sheets

MULTIPLE INFORMATION UNIT PACKAGING CARD

FIELD OF THE INVENTION

The present invention relates to a packaging card for displaying multiple units of a product and more particularly to a packaging card for displaying multiple units of a product which separates into packaging cards for displaying individual units of a product.

BACKGROUND OF THE INVENTION

Small items such as rolls of tape are often displayed using a packaging card which attaches to the product and contains product information such as the product name, manner of use, and price. The product may then be placed on a shelf where the product and the upstanding packaging card are visible to prospective purchasers. Alternatively, a hole may be punched in the packaging card so that the card can be hung from a rod projecting from a vertical panel. In both manners of display, prospective purchasers can easily view both the product and information pertaining thereto. This manner of displaying small items is in widespread use.

Frequently, producers wish to promote a product by offering it at a special price or selling multiple units of a product for less than each unit would cost if sold separately. Additionally, two different products of a manufacturer may be sold together at a special price. This requires manufacturing a special packaging card which can accommodate multiple units of the product or products being promoted. This multiple unit card will contain language to the effect that this multiple unit package is being sold at a special price, etc. In this manner, a purchaser might be encouraged to try this particular product instead of a competing brand.

Packaging cards also generally contain UPC codes to identify the product to a computer. The code consists of vertical bars having differing widths and numbers thereunder. The product can be identified by scanning the vertical bars with a laser scanner or by entering the individual numbers into a cash register by hand. Since the price to be charged depends on the UPC symbol read by a computer, products which come in different sizes must be identified by separate UPC symbols. This also allows an accurate inventory to be kept of the number of each size of product which remains in the store. Thus, it is evident that when items which are normally sold individually are promoted and sold in a special multiple package, a distinct UPC code is needed to identify the multiple package.

Promotions such as the above are only designed to run for a limited period of time. When the promotion is over, a seller may wish to remove the multiple unit packages from his display and return to selling each individual item for its original price. Alternately, a seller may sell all but a few of the promotional items and not have room on his shelves to display both individual and multiple unit packages. The unsold products, or the products remaining after a promotion would then have to be returned to the manufacturer for repackaging. This is costly and inefficient and decreases the desirability of promotions such as the above.

SUMMARY OF THE INVENTION

To overcome these problems, the present invention comprises a packaging card for displaying multiple units of a product in one package at a promotional price which can be separated into separate units of packaging each containing a complete set of product information. This packaging includes a UPC symbol for the multiple-unit pack and UPC symbols on each of the individual packages. The individual UPC symbols are not visible when the card is in its multiple-unit configuration. A portion of the package containing the promotional information and UPC symbol can be removed to reveal individual package UPC symbols. The portion of the packaging bearing the promotional information can then be discarded and the remainder separated into individual units.

It is, therefore, a principal objective of the present invention to provide a packaging card for displaying multiple units of a product which can be converted into packaging cards for displaying individual units of a product.

It is another object of the present invention to provide a packaging card which presents one UPC symbol in its multiple-package configuration and individual UPC symbols when separated.

It is still another object of the present invention to provide a multiple unit packaging card which hides the individual UPC symbol when in its multiple-unit configuration.

It is a further object of the present invention to provide a packaging card which facilitates the use of multiple unit promotions.

It is yet another object of the invention to provide a packaging card from which promotional information can be removed at the end of a promotion.

These and other objectives and advantages of the invention will become apparent from the following detailed description when read in conjunction with the drawings.

DETAILED DESCRIPTION OF THE PREFERRED EMBODIMENT

Figure 2:
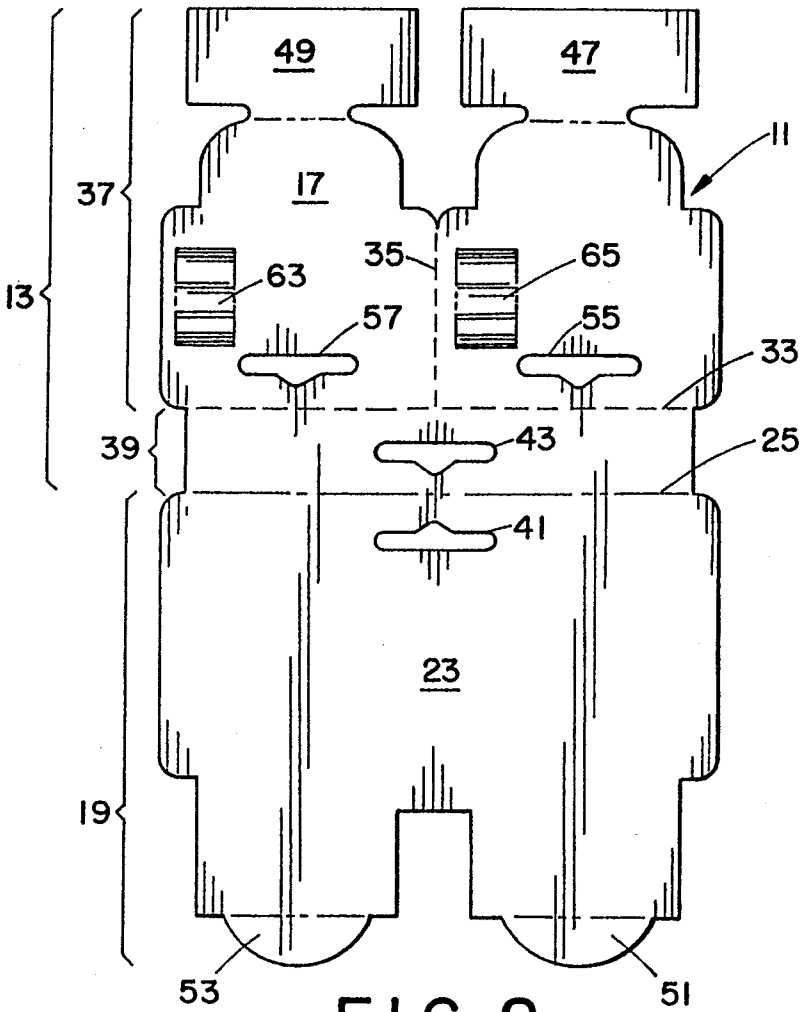
FIG. 2 is a rear view of the packaging card of FIG. 1.
Figure 1:
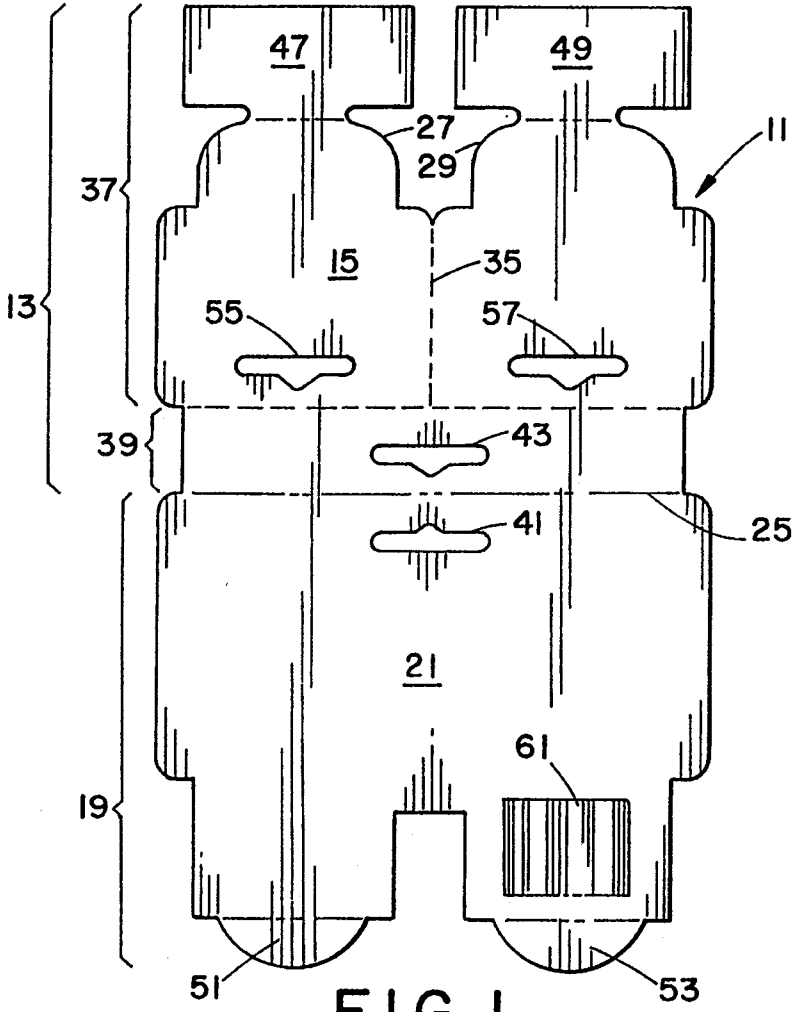
FIG. 1 is a frontal view of a packaging card according to the present invention.
Figure 4:
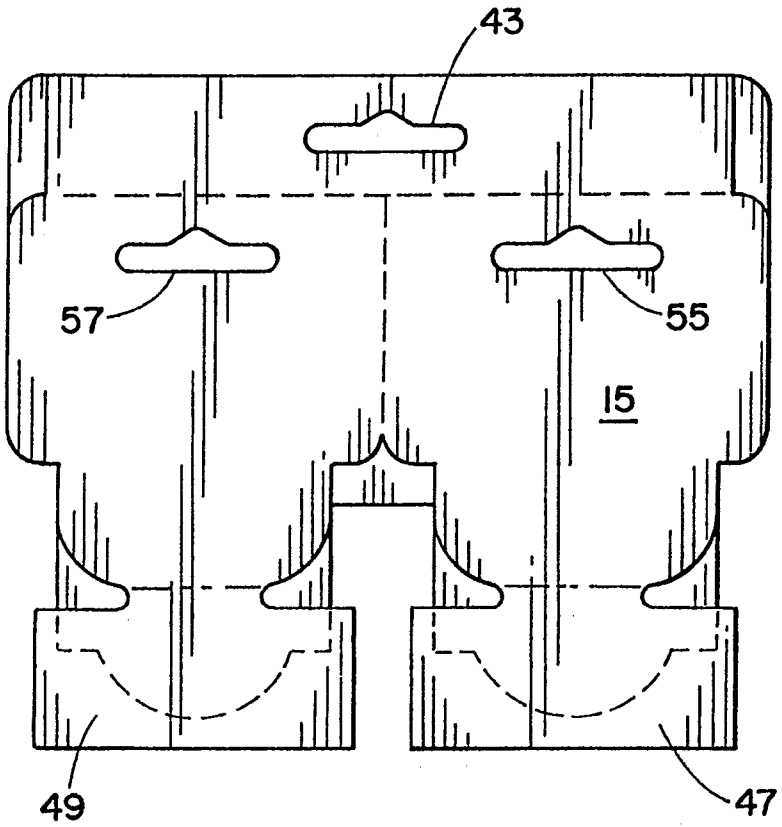
FIG. 4 is a rear view of the folded packaging card of FIGS. 1–3.
Figure 3:
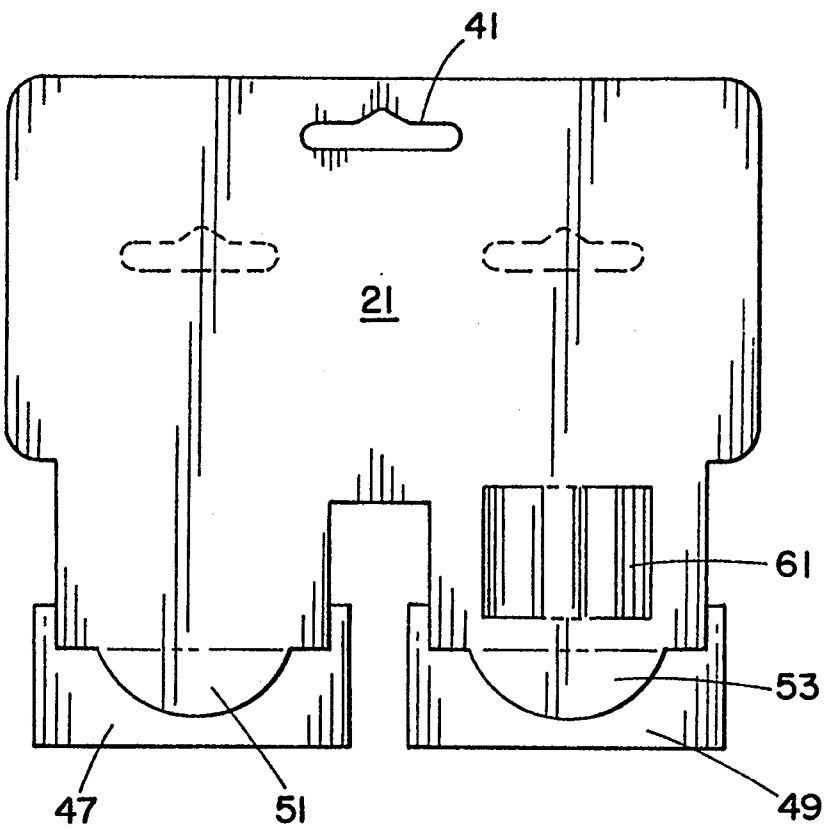
FIG. 3 is a frontal view of the card of FIGS. 1–2 in a folded configuration.

Reference is now made to the drawings wherein the showings are for the purpose of illustrating a preferred embodiment of the invention only and not for the purpose of limiting same. The present invention comprises a packaging card for displaying multiple units of a product during a promotion which can be separated into packaging cards for displaying individual units of a product, each with appropriate price and product information.

FIGS. 1–4 show a packaging card 11 according to the present invention. The packaging card 11 includes a top section 13, having a front 15 and a back 17, and a bottom section 19, having a front 21 and a back 23. The top section 13 and the bottom section 15 are separated by a scored line 25. The top section 13 is further divided into an upper part 37 and a lower part 39. The upper part 37 comprises two individual unit cards 27, 29 separated from each other by a perforated line 35 and from the lower part 39 by a perforated line 33. The top section 13 includes attachment pieces 47, 49 for securing a product 59 to the card 11. The bottom section 21 includes two tabs 51 and 53. These tabs 51, 53 do not serve to support the product 59 but merely to hold the bottom section 19 of the packaging card 11 against the top section 13 when the packaging card 11 is folded along scored line 25. Furthermore, the bottom section 19 includes an opening 41 which is aligned with an opening 43 in the lower part 39 of the top section 13. These openings allow the multiple unit packaging card to be hung from a hook. The upper part 37 of the top section 13 also includes two openings 55, 57 in the individual unit cards 27, 29 so that the cards 27, 29 may each be hung from hooks when the multiple unit card 11 is separated.

Figure 6:
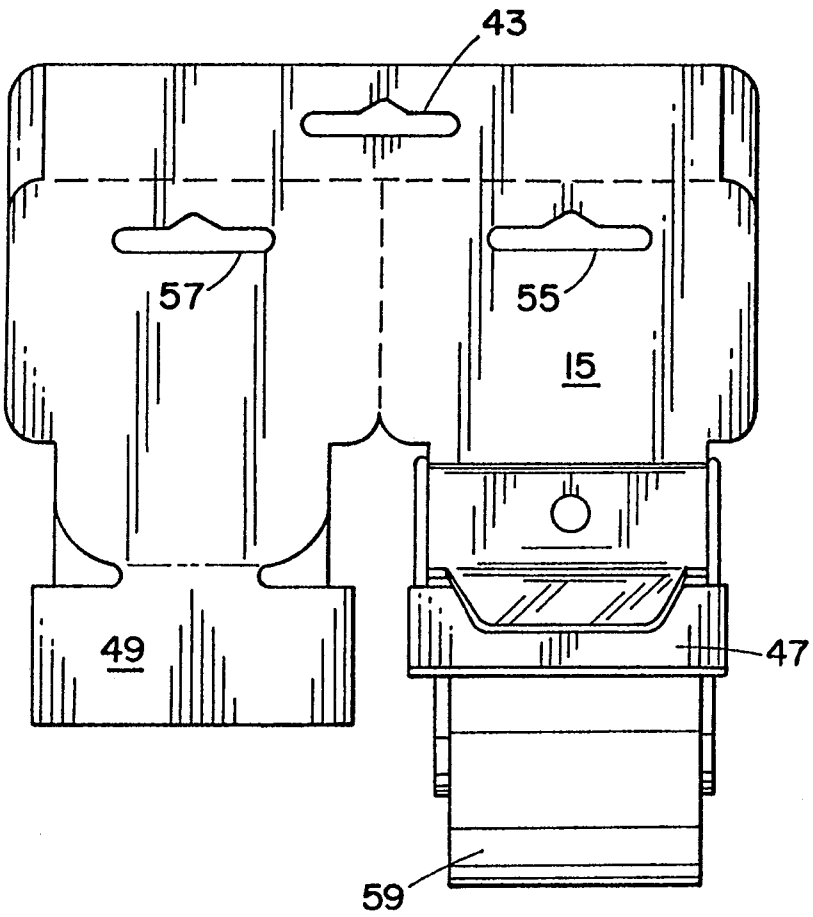
FIG. 6 is a rear view of the packaging card of FIGS. 1–5 attached to a product.
Figure 5:
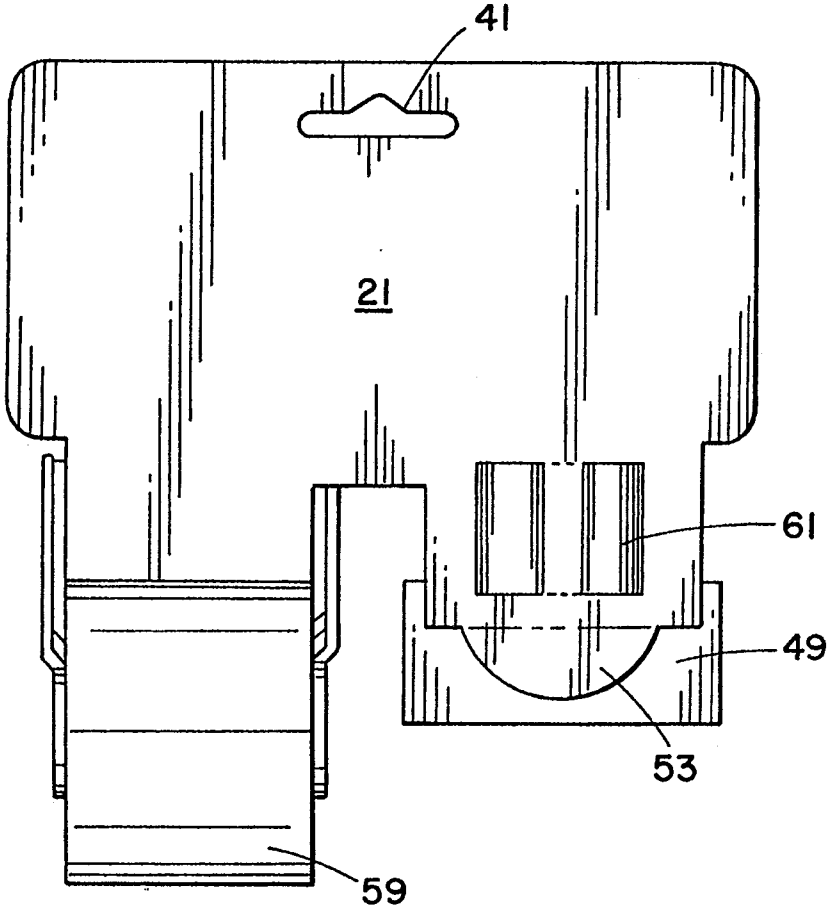
FIG. 5 is a frontal view of the packaging card of FIGS. 1–4 attached to a product.

FIGS. 5–6 show a product 59 attached to an attachment piece 47 or 49. Card 11 is then folded along the scored line 25 so that the back 23 of the bottom part 19 is adjacent to the back 17 of the top section 13. The tabs 51, 53 are then inserted between the product 59 and the back 17 of the upper part 13, to maintain the card 13 in a folded configuration.

A location 61 for a multiple pack UPC symbol is provided on the front 21 of the bottom part 19. Two locations 63, 65 are provided on the back 17 of the top part 13, one on each of the individual unit cards 27, 29. When the packaging card 11 is folded and attached to a product 59, the locations 63, 65 will not be visible. The only apparent UPC symbol will be the one located in location 61. When a promotion ends, a merchant can separate the upper part 37 of the top section 13 along the perforated line 33 and discard the bottom section 19 and the lower part 39 of the upper section 13. The individual unit cards 27, 29 can be separated along the perforated line 35, and hung from the holes 55, 57 in each individual unit card 27, 29. It will be apparent that the individual UPC location 63, 65 on each of the individual unit cards 27, 29 is now visible and that the bottom section 19 bearing the multipack UPC location 61 has been discarded. Thus the appropriate pricing information is provided for both a multiple-unit package and for individual unit packages while avoiding confusion as to the correct price to be charged.

The product 59 is only attached to the product card 11 by the tabs 47, 49. The tabs 47, 49 support a product 59 in both the multiple unit package configuration and in the individual unit configuration. Because the tabs 51, 53 are not actually attached to a product 59, separation of bottom section 21 and lower part 39 of top section 13 is facilitated.

The invention has been described with reference to a preferred embodiment. Of course, this same invention can be used to join three individual products into one separable promotion package. This and other variations and modifications of the invention will occur to others upon the reading and understanding of this specification. It is intended that all such variations, alterations and modifications, be included insofar as they come within the scope of the appended claims or the equivalents thereof.

Having thus defined the invention, the following is claimed:

1. A packaging card comprising:

a top section and a bottom section, said top section having a front and a back and said bottom section having a front and a back;

a scored line separating said top section from said bottom section;

a first portion of information displayed on said front of said bottom section;

a second portion of information displayed on said front of said top section;

a third portion of information displayed on said back of said top portion;

said packaging card having a first configuration in which said card is folded along said scored line such that said back of said top section overlays said back of said bottom section whereby said third portion of information is hidden; and a second configuration in which said upper top section is detached from said lower top section along said perforated line whereby said third portion of information is visible.

2. A packaging card including a top section and a bottom section separated by a perforated line, said top section comprising at least two individual packaging cards separated from each other by a perforated line wherein each of said at least two individual packaging cards further comprises:

a generally rectangular main body section having a width and an opening adapted to receive a display rod;

a generally rectangular middle section having a width, said width being less than the width of said main body section and having rounded upper corners;

a neck portion having a width, said width being less than the width of said middle section and being located between said rounded corners of said middle section;

a generally rectangular end section having a width, said width being approximately equal to the width of said main body section and said end section being attached to said neck section; and said bottom section comprising an upper part and a lower part separated by a scored line, said upper part having an opening therein adapted to receive a display rod, and said upper part having a width which is less than the width of said main body section of said top section and said lower part comprising a generally rectangular main body part having a width substantially equal to the sum of the widths of the main body parts of the top section of said packaging card, an opening adapted to receive a display rod and at least two generally rectangular tabs depending from said main body part of said lower part.

* * * * *